US005577406A

United States Patent [19]

Grønbæk

[11] Patent Number: 5,577,406

[45] Date of Patent: Nov. 26, 1996

[54] FORMING TOOL

[75] Inventor: Jens Grønbæk, Varnæsvej, Denmark

[73] Assignee: Danfoss A/S, Nordborg, Denmark

[21] Appl. No.: 525,773

[22] PCT Filed: Mar. 28, 1994

[86] PCT No.: PCT/DK94/00130

§ 371 Date: Sep. 20, 1995

§ 102(e) Date: Sep. 20, 1995

[87] PCT Pub. No.: WO94/22607

PCT Pub. Date: Oct. 13, 1994

[30] Foreign Application Priority Data

Apr. 6, 1993 [DE] Germany ..... 43 11 249.8

[51] Int. Cl.[6] ..... B21C 3/12

[52] U.S. Cl. ..... 72/467; 72/481.9

[58] Field of Search ..... 72/467, 481.9, 72/274, 478; 76/107.4

[56] References Cited

U.S. PATENT DOCUMENTS

| | | | |
|---|---|---|---|
| 2,568,440 | 9/1951 | Friedman | 72/467 |
| 3,628,370 | 10/1969 | Phillips, Jr. | 72/467 |

FOREIGN PATENT DOCUMENTS

| | | | |
|---|---|---|---|
| 0013826 | 4/1980 | Japan | 72/478 |
| 0174243 | 10/1984 | Japan | 72/478 |
| 31520 | 2/1989 | Japan | 72/467 |
| 0967654 | 10/1982 | U.S.S.R. | 72/478 |
| 1136869 | 1/1985 | U.S.S.R. | 72/467 |
| 1477498 | 5/1989 | U.S.S.R. | 72/467 |

*Primary Examiner*—David Jones
*Attorney, Agent, or Firm*—Lee, Mann, Smith, McWilliams, Sweeney & Ohlson

[57] ABSTRACT

A deforming tool having a die and prestress ring for the extrusion of a workpiece. The prestress ring being constructed so that the radial prestress exerted by it on the die in a region of transition from one to the other of two converging inner faces of the die, which together form an internal angle of less than 180 degrees, and/or in the region of a sudden transition from a low to a high value of the pressure exerted by the workpiece during its deformation radially on the die, is less than in the regions adjacent to the transition.

13 Claims, 5 Drawing Sheets

FORMING TOOL

Figure 1:
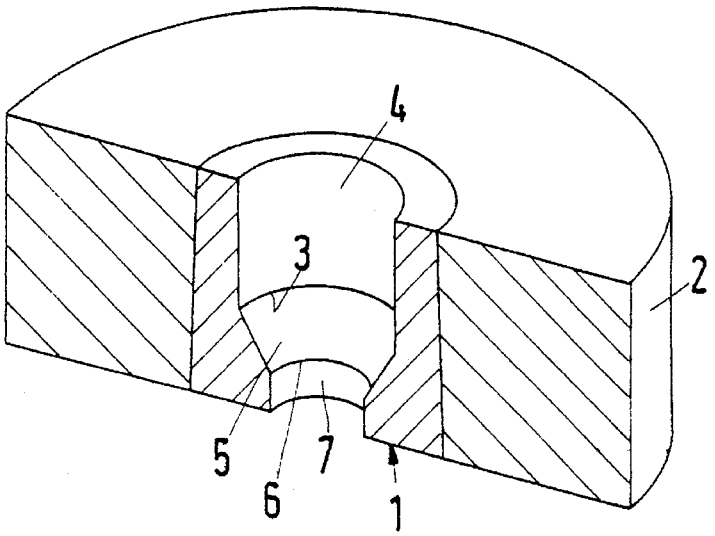

The invention relates to a forming tool having a die and a prestressing ring surrounding the die.

Such a forming tool can be used for cold-extrusion. The die optionally consists of steel, especially of sintered hard metal.

In a known forming tool of that kind (DE 38 34 996 C2), which is used for cold extrusion the die is cylindrical, and the prestress exerted by the prestressing ring ensures that plasticizing, fatigue or rupture of the die as a result of internal excess pressure is avoided.

Dies used for extrusion of workpieces are, however, often polygonal in cross-section and axial section, that is to say, they have a transition from one to the other of two converging inner faces of the die that form an angle of less than 180°. In the region of these transitions, as a consequence of stress concentrations and the repeated cyclic loading very high tensile stresses which exceed the yield stress of the die material can occur, or cracks and fatigue fractures can appear.

The service life of such a forming tool is accordingly short. It is therefore also known (U.S. Pat. No. 3,810,382) for the die, which is prestressed by an encircling band, to be constituted by several individual parts. Such a solution is expensive, however.

Such cracks and fatigue fractures can also appear in a region of the die in which its stress by radial pressure during deformation of the workpiece changes abruptly from a low value, usually zero, to a high value, for example approximately level with the end face of a workpiece located in the die on which a press stamp is acting, when the edge of this end face is contacted by the inside of the die, even when the inside is cylindrical.

The invention is based on the problem of providing a forming tool of the kind mentioned in the introduction, which, when using a one-part die, can be subjected to relatively high stress at transitions of the said kind without the risk of the die being destroyed.

According to the invention, this problem is solved in that the prestressing ring is constructed so that the radial prestress exerted by it on the die in the region of a transition from one to the other of two converging inner faces of the die, which together form an internal angle of less than 180°, and/or in the region of a sudden transition from a low to a high value of the pressure exerted by the workpiece during its deformation radially on the die, is less than in the regions adjacent to the transition.

In this solution a flexural prestress is produced around the transitions. This counteracts the formation of cracks.

With a cylindrical die or a cylindrical prestressing ring, the connection of the two can be effected by thermal shrinking, in that the prestressing ring is heated or the die is cooled and the prestressing ring is then pushed onto the die.

Preferably, the engagement surfaces of prestressing ring and die are conical. This facilitates joining of the same by axial pressing, so that a force fit is obtained.

Preferably, at least one of the two engagement surfaces of prestressing ring and die is machined in accordance with a desired prestress distribution. Instead of that, or in addition thereto, the material properties of the die and/or prestressing ring can be selected in accordance with a desired prestress distribution. This enables the radial forces in the region of the transitions to be matched in an optimum manner.

Using conventional shrink rings of solid steel, it is not in practice possible to achieve a radial prestress distribution with a modification of more than 10 to 15%.

By dividing the prestressing ring into at least two concentric rings, however, these values can be increased. At least one of the prestressing rings can therefore be surrounded by a reinforcing band. This lengthens the service life of the prestressing ring. In addition, the entire reinforcing is strengthened from 50 to 70%, and consequently an increase in the modification of the prestress distribution is possible, so that its maximum value can be around 75 to 125% of the minimum value.

Thus, at least one of the two engagement surfaces of prestressing ring and reinforcing band can be machined in accordance with the desired prestress distribution.

Furthermore, it is possible to machine the inner or outer side of an intermediate tube, which is arranged between the die and the prestressing ring, or the outside of the die adjacent to the intermediate tube in accordance with the desired prestress distribution. This intermediate tube is able to reduce harmful influences on the die caused by high forces occurring during assembly and in operation.

In all cases, the engagement surfaces can be superfinished, for example polished. This enables the desired prestress distribution to be very exactly configured.

It is thus possible to ensure that the prestressing ring has regions of alternating material properties. In particular, the prestressing ring can consist of several rings of different material rigidity and/or different radial dimensions. It is thus possible to configure the desired prestress distribution in a simple manner.

Figure 2:
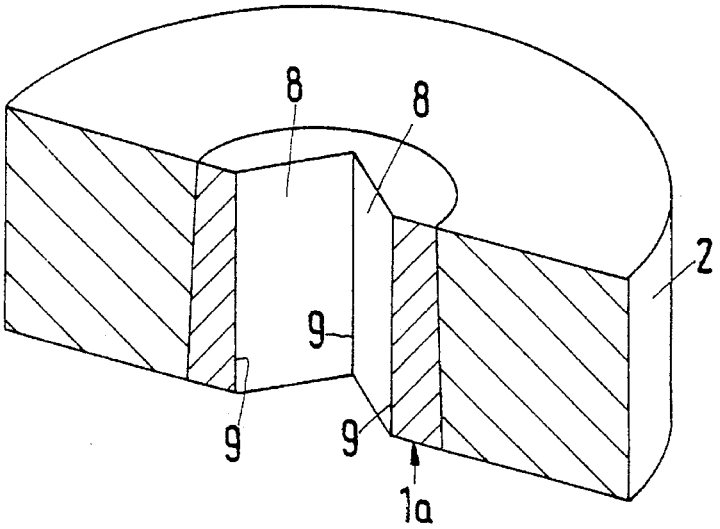
Figure 3:
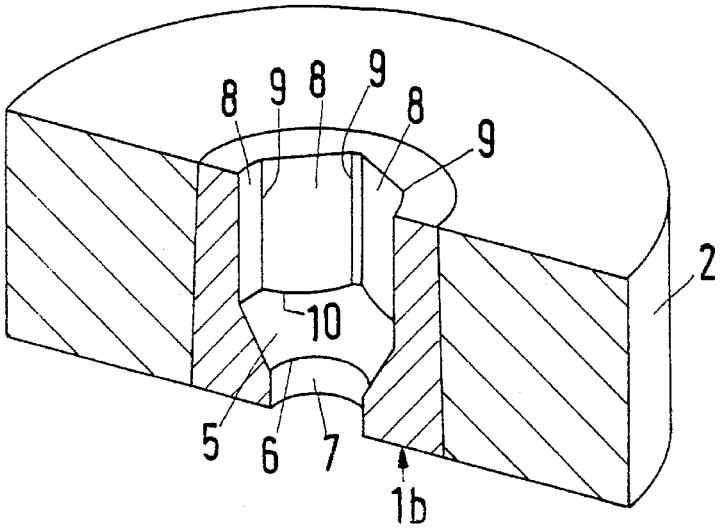
Figure 4:
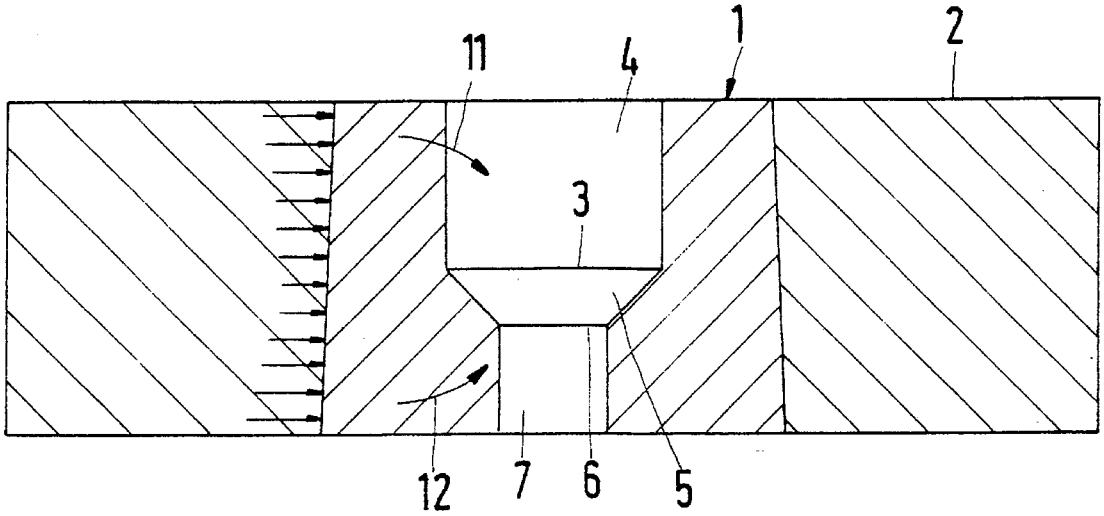
Figure 12:
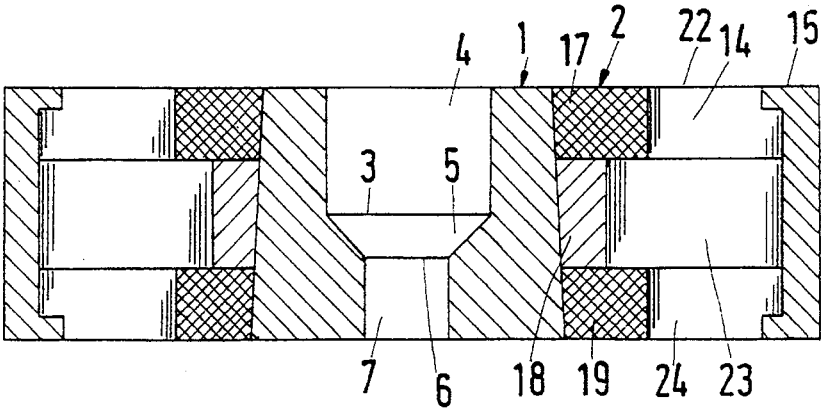
Figure 13:
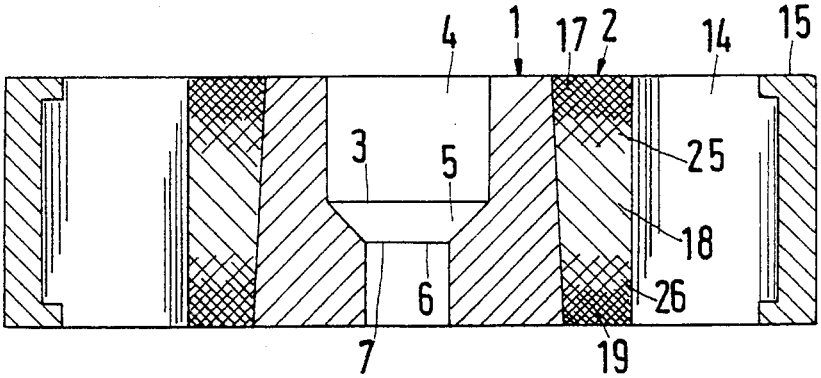
Figure 14:
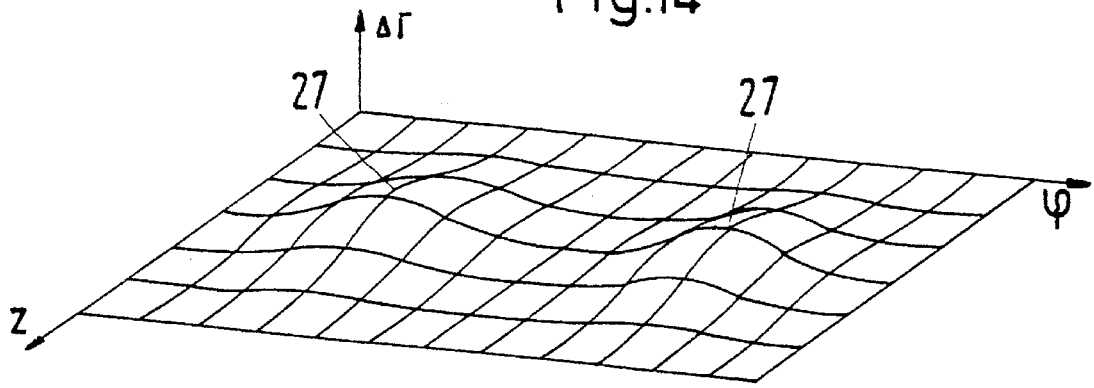
Figure 15:
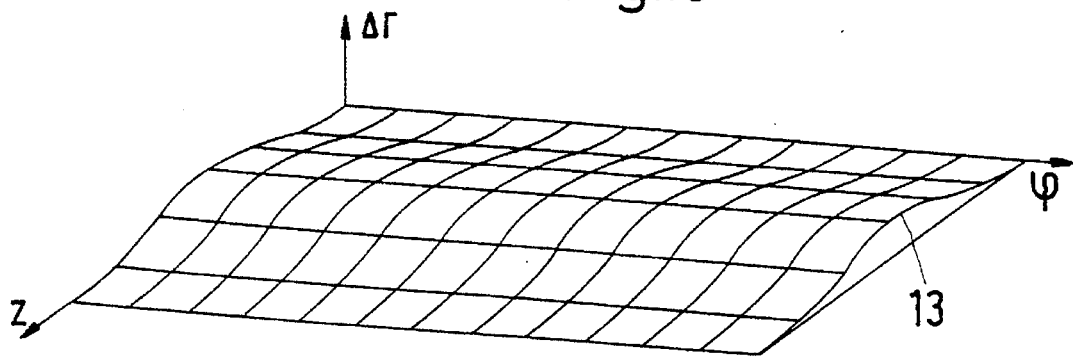
Figure 16:
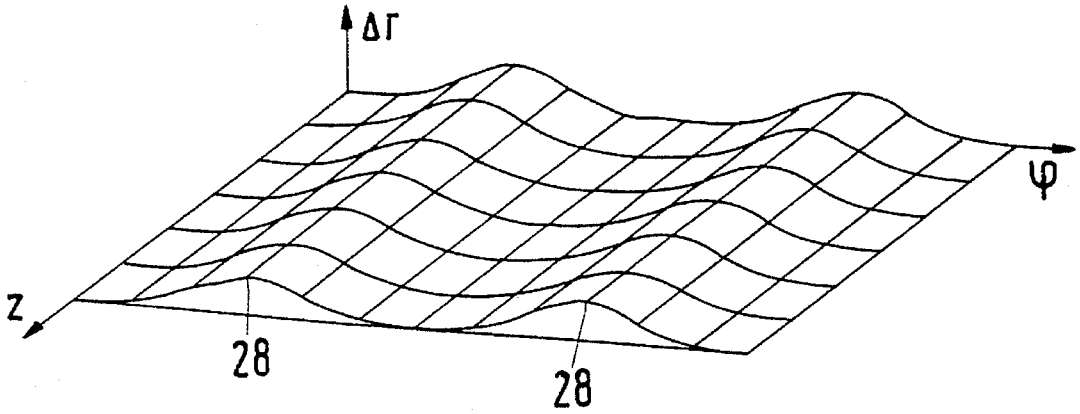

The invention and its developments are described in detail hereinafter with reference to drawings of preferred embodiments, in which FIGS. 1 to 3 show diagrammatically in axial section different embodiments of the invention in their application to dies having different inner contours, FIG. 4 is a diagrammatic illustration, in axial section, of a forming tool according to the invention for explaining the inventive concept, FIGS. 5 to 13 show, in axial section, different embodiments of forming tools according to the invention, and FIGS. 14 to 16 show developed views of different engagement surfaces of die and prestressing ring.

The forming tool shown in FIG. 1 contains a die 1 in a prestressing ring 2, the engagement surfaces of die 1 and prestressing ring 2 being conical. The inside of the die 1 has a transition 3 in the form of a circular edge at which a first circular cylindrical inner face 4 changes into a conical second inner face 5, the two inner faces 4 and 5 forming an internal angle of less than 180°. The conical inner face 5 then changes at a further edge 6 into a third circular cylindrical inner face 7, the two inner faces 5 and 7 forming an internal angle of more than 180°. The die 1 and the prestressing ring 2 have conical engagement surfaces of complementary cone angle and are held together with a force fit.

Such a forming tool can be used to form by cold extrusion a conically stepped workpiece or a cylindrical workpiece having a diameter corresponding to the diameter of the inner face 7.

The forming tool shown in FIG. 2 differs from that shown in FIG. 1 merely in that the inner contour of the die 1*a* is in the form of a rectangle, the inner faces 8 of which converge at transitions 9 formed by the edges at internal angles of 90°.

A round slug which has been compressed by pistons from both end faces can be introduced into the die 1*a* of such a forming tool. It is possible in this manner to manufacture polygonal nut components, into which a thread is cut.

The forming tool shown in FIG. 3 differs from that shown in FIG. 1 likewise merely in the inner contour of the die 1*b*. Here, the upper part of the inner contour is hexagonal, the inner faces likewise forming internal angles of less than 180°, in this case 60°, at the transitions 9 formed by the edges; the transitions 9 can also be bevelled or rounded. Using this forming tool, workpieces in partially round and partially hexagonal form can be manufactured by cold extrusion.

FIG. 4 illustrates diagrammatically the basic principle of the invention in the forming tool shown in FIG. 1. According to that principle, the prestressing ring 2 is designed so that the radial prestress it exerts on the die 1, indicated by the arrangement of parallel arrows, in the region of the transition 3 from one to the other of the two converging inner faces 4, 5 is less than in the regions adjacent to the transition. This generates a flexural prestress, indicated by the two curved arrows 11 and 12, around the transition 3, so that as the internal pressure is exerted the critical cross-section is relieved of stress in a plane coinciding with the transition 3, and thus formation of cracks because of a stress concentration in this region is counteracted.

The manner in which this varying distribution of the prestress can be achieved is explained hereinafter by the example of FIGS. 5 to 13.

Figure 5:
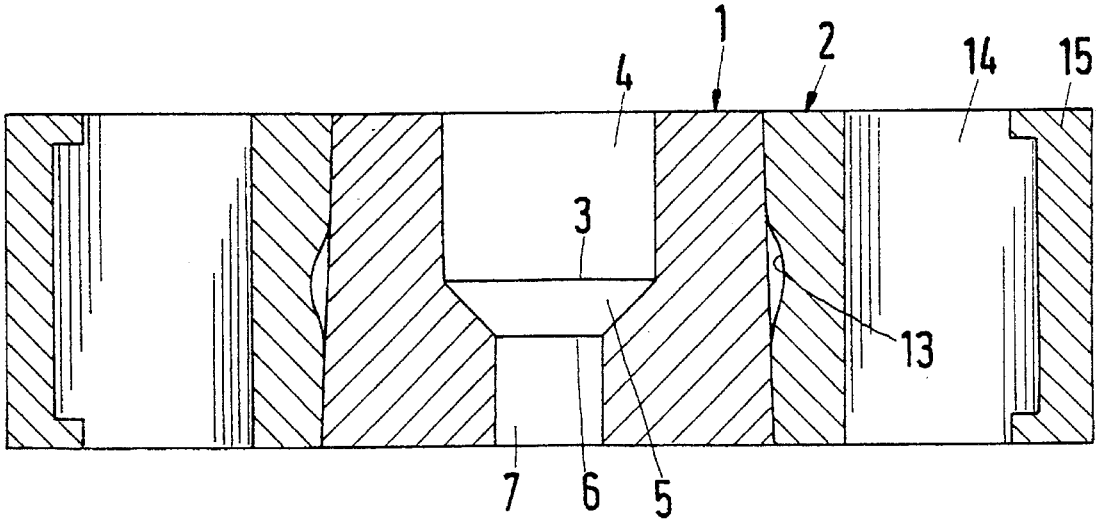

According to FIG. 5, the conical inner face of the prestressing ring 2 lying adjacent to the conical outer face of the die 1 has a circumferential groove 13 machined into it, for example, by grinding, in the region of the transition 3, the radial depth of which groove is greatest at the level of the transition 3, or rather in the radial plane thereof, and which decreases continuously with no transition in an axial direction towards the edges of the groove 13. In the region of the groove 13 the prestressing ring 2 therefore lies with less radial pressure against the die 1, so that the prestress it exerts on the die is lowest in the region of the groove 13 and greatest outside the groove 13. The prestressing ring 2 is furthermore enclosed by a reinforcing band 14 in the form of a encircling band of sheet metal which prolongs the service life of the prestressing ring 2. In this manner a 50 to 70% stronger reinforcement of the die 1 can be achieved, which corresponds to an increase in the desired prestress so that the maximum prestress amounts to 75 to 125% of the minimum value. The reinforcing band 14 is further surrounded by an outer ring 15, which forms a housing.

Figure 6:
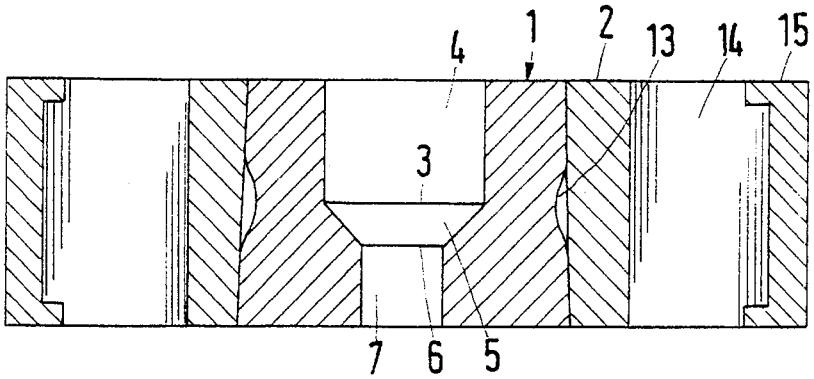

The embodiment shown in FIG. 6 differs from that shown in FIG. 5 merely in that the groove 13 is machined not in the prestressing ring 2 but in the outside of the die 1.

Figure 7:
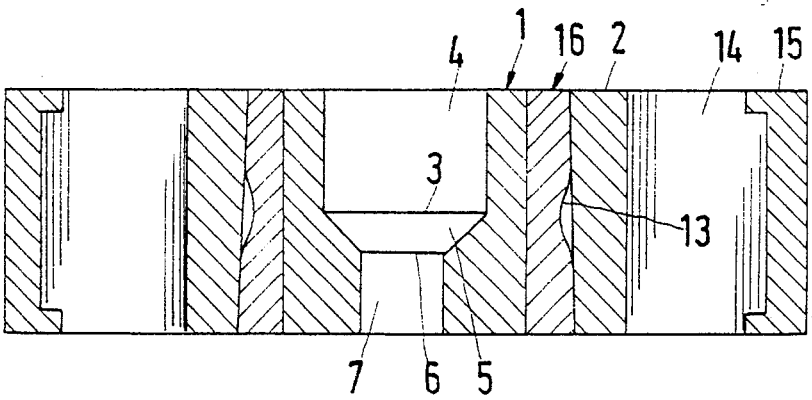

The embodiment shown in FIG. 7 differs from that shown in FIG. 6 essentially only in that an intermediate tube 16 is shrunk down onto the die 1 between the die 1 and the prestressing ring 2, the adjacent surfaces of die 1 and intermediate tube 16 are circular cylindrical, and the outside of the intermediate tube 16 has the same but complementary cone angle as the adjacent inner face of the prestressing ring 2 and contains the groove 13. The die 1 can accordingly be constructed with thinner walls.

Figure 8:
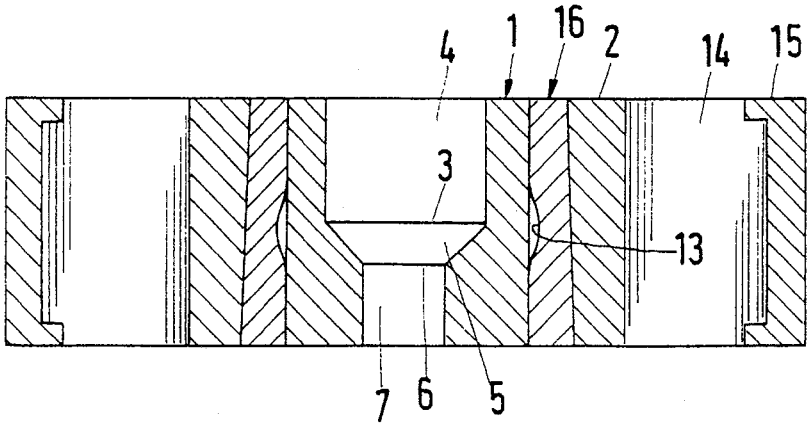

The embodiment shown in FIG. 8 differs from that shown in FIG. 7 merely in that the groove 13 is formed not on the outside but on the inside of the intermediate tube 16.

Figure 9:
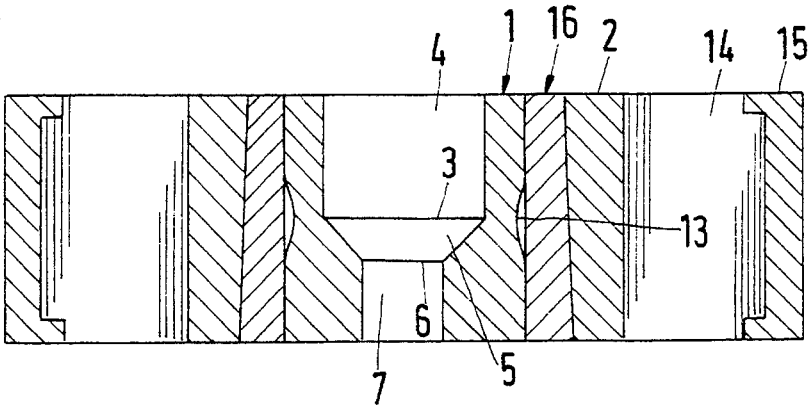

The embodiment shown in FIG. 9 differs from that shown in FIGS. 7 and 8 merely in that it is not the intermediate tube 16 but the outside of the die 1 that is provided with the groove 13.

The radial depth of the groove 13 in all examples is only several hundredths to a few tenths of a millimeter and has been illustrated on an exaggeratedly large scale in the drawings.

Figure 10:
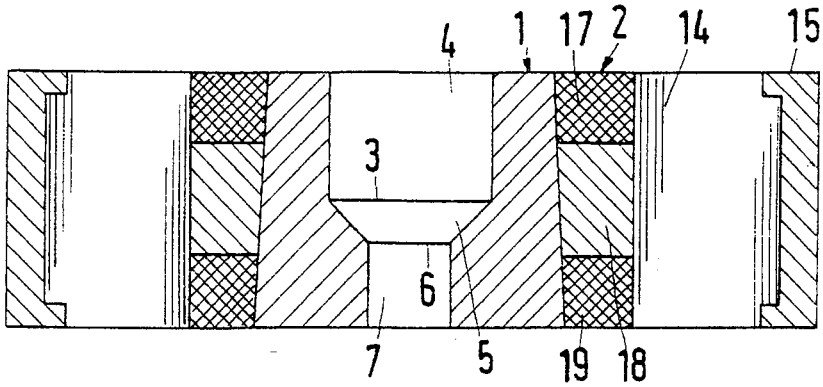

The embodiment shown in FIG. 10 differs from that shown in FIG. 5 merely in that the prestressing ring 2 comprises three axially adjacent regions 17, 18 and 19 with alternating material properties, the regions 17 to 19 being formed by separate rings of which the two outer rings 17 and 19 have a greater rigidity or hardness than the middle region 18. The distribution of prestress is therefore similar to that illustrated in FIG. 4.

Figure 11:
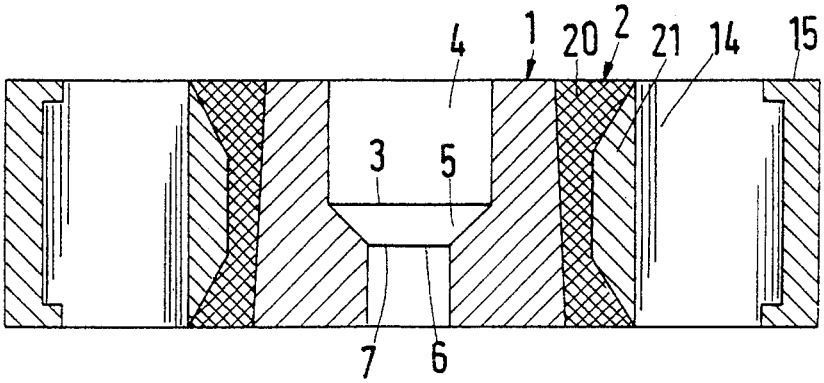

The embodiment shown in FIG. 11 differs from that shown in FIG. 5 merely in that the prestressing ring 2 comprises a radially inner region 20 and a radially outer region 21, which have different material properties. The regions 20 and 21 are thus in the form of rings, of which the radially inner ring has a greater material rigidity than the radially outer ring, the engagement surfaces of the regions 20 and 21 being trapezoidal in cross-section and the longer of the two parallel sides of the trapezium lying radially outside and the trapezium being equal-sided.

The embodiment shown in FIG. 12 differs from that shown in FIG. 10 merely in that the outer diameter of the middle region 18 is smaller than the outer diameter of the embodiment shown in FIG. 10, only about half the size, and the reinforcing band 14 is divided into three axially adjacent encircling bands 22, 23 and 24, of which the middle encircling band 23 has a smaller internal diameter than the two outer encircling bands 22, 24.

The embodiment shown in FIG. 13 differs from that shown in FIG. 10 merely in that the prestressing ring 2 comprises five axially merging regions 17, 18, 19, 25 and 26, which have alternating material properties. The intermediate regions 25 and 26 lying between the axially outer regions 17 and 19 on the one hand and the middle region 18 are more rigid or harder than the middle region 18 but less rigid than the outer regions 17 and 19.

FIG. 14 illustrates the developed view of the inner face of a prestressing ring 2, as can be provided in the case of the embodiment shown in FIG. 3, in the form of a diagram in cartesian coordinates, $\Delta r$ indicating the deviation of the surface of a circular cylindrical face in a radial direction outwards, z indicating the axial direction of the prestressing ring 2, and $\psi$ indicating the circumferential direction. As one sees, the prestressing ring 2 has depressions 27 on its radially inner surface (which are illustrated as raised areas or humps because of the direction of $\Delta r$), each of which faces towards one of the corners of the die 1*b* at the intersection of transitions 9 and 10; of the total of eight depressions 27 in the case of the die 1*b*, only two are illustrated. Conversely, the areas between the depressions 27 represented as "valleys" face towards the transitions 9 of the die 1*b*.

The surface shown as a developed view in FIG. 15 corresponds to the radially inner surface of the prestressing ring 2 shown in FIG. 5, the groove 13 being illustrated as a hump (because of the sign of $\Delta r$).

The surface of the inside of the prestressing ring 2 illustrated in FIG. 16 corresponds to a construction of the die 1*a* shown in FIG. 2, each transition 9 having associated with it a depression 28 (again illustrated as a wave-like hump) extending axially in the z-direction. That is to say, altogether four depressions are provided where the die 1*a* is a rectangular socket, but only two are shown.

It is clear that the surface illustration shown in FIG. 15 also applies, for example, to the die 1 shown in FIG. 6, if the direction of $\Delta r$ in FIG. 15 is reversed.

I claim:

1. A forming tool having a die and a prestressing ring surrounding the die and exerting radial prestress on the die, in which the prestressing ring is constructed so that the radial prestress exerted by it on the die, in at least one of a region of a transition from one to another of two converging inner faces of the die, which together form an internal angle of less than 180° and a region of a sudden transition from a low to a high value of pressure exerted by a workpiece during its deformation radially on the die, is less than in regions adjacent to the transition.

2. A forming tool according to claim 1, in which engagement surfaces of the prestressing ring and die are conical.

3. A forming tool according to claim 2, in which at least one of the two engagement surfaces of the prestressing ring and die is machined to have a predetermined prestress distribution.

4. A forming tool according to claim 1, in which material properties of at least one of the die and the prestressing ring are selected to have a predetermined prestress distribution.

5. A forming tool according to claim 1, in which the prestressing ring consists of at least two concentric rings.

6. A forming tool according to claim 1 in which the prestressing ring is surrounded by a reinforcing band.

7. A forming tool according to claim 6, in which at least one of two engagement surfaces of the prestressing ring and reinforcing band is machined to have a predetermined prestress distribution.

8. A forming tool according to claim 1, including an intermediate tube between the die and the prestressing ring.

9. A forming tool according to claim 8, in which one of an inner and outer side of the intermediate tube is machined to have a predetermined prestress distribution.

10. A forming tool according to claim 8, in which an outside surface of the die adjacent the intermediate tube is machined to have a predetermined prestress distribution.

11. A forming tool according to claim 3, in which the engagement surface is superfinished.

12. A forming tool according to claim 1, in which the prestressing ring has regions of alternating material properties.

13. A forming tool according to claim 12, in which the prestressing ring consists of several rings having at least one of a different material rigidity and different radial dimensions.

* * * * *